United States Patent [19]

Allard et al.

[11] 3,995,370

[45] Dec. 7, 1976

[54] GUARD FOR CHAIN SAW GUIDE BAR

[75] Inventors: Patrice Allard; Yvon Dallaire, both of Kapuskasing, Canada

[73] Assignee: Omark Industries, Inc., Portland, Oreg.

[22] Filed: June 6, 1975

[21] Appl. No.: 584,575

[52] U.S. Cl. ..... 30/382

[51] Int. Cl.[2] ..... B27B 17/02

[58] Field of Search ..... 30/382, 383, 387; 83/820

[56] References Cited

UNITED STATES PATENTS 2,348,612 5/1944 Deacon ..... 30/382

*Primary Examiner*—Al Lawrence Smith
*Assistant Examiner*—J. C. Peters
*Attorney, Agent, or Firm*—Robert L. Harrington

[57] ABSTRACT

A guide bar has a groove extending along the top and bottom edges and continues in a semi-circular path around the outer end. A cutting chain has drive tangs that slide in said groove to guide the cutting chain along the edges of the bar. A thin rigid plate is fixed to one or both sides of the guide bar near the outer end thereof and extends slightly past the outer end to form a safety rail that reduces the degree of hooking that is caused by the depth gauges and cutters of the cutting chain digging into or hooking onto a tree or branch being cut.

1 Claim, 6 Drawing Figures

GUARD FOR CHAIN SAW GUIDE BAR

HISTORY OF INVENTION

This invention relates to a chain saw guide bar and more specifically to a guard plate affixed to the guide bar to prevent or reduce hooking of branches or the like as the saw chain passes around the outer end of the guide bar.

It is well known in the logging industry that the greatest danger to the user of a chain saw occurs when a tree or limb is engaged by the cutting chain at the point when the chain is passing around the top quadrant at the outer end of the bar. The path of the chain around the end of the bar orients the chain in a way which causes the cutters or depth gauge leading the cutter to dig in or hook and results in the bar end kicking up and back at the operator.

Affixing a guard to the outer end of the bar has been suggested for example as shown in the Canadian patent, number 691,629. However, such guards are designed to cover the chain to prevent any cutting at these danger areas. This solution is not satisfactory as such guards tend to restrict or interfere with cutting down large trees having a diameter greater than the bar length and in delimbing where the cutting capability of the bar end (referred to as the bar nose) is desired.

The present invention provides a very simple and inexpensive solution that does not prevent nose cutting. In the preferred embodiment of the invention, a thin rigid metal plate is affixed to the bar and extends slightly over the end. A curved outer rail is formed by the plate that conforms to the curved path of the cutters but just short of the outer reach of the cutters. This outer rail functions to prevent the cutters from the undesired digging in explained above. The cutters are typically formed with a bend that extends the cutting edge outwardly of the bar sides to cut a substantially wider kerf than the bar width. The guard plate is formed to fit just under this bend in the cutter. The plate is sufficiently thin to allow clearance with the side wall of the kerf.

This invention will be more clearly understood by reference to the following detailed description and drawings wherein.

Figure 1:
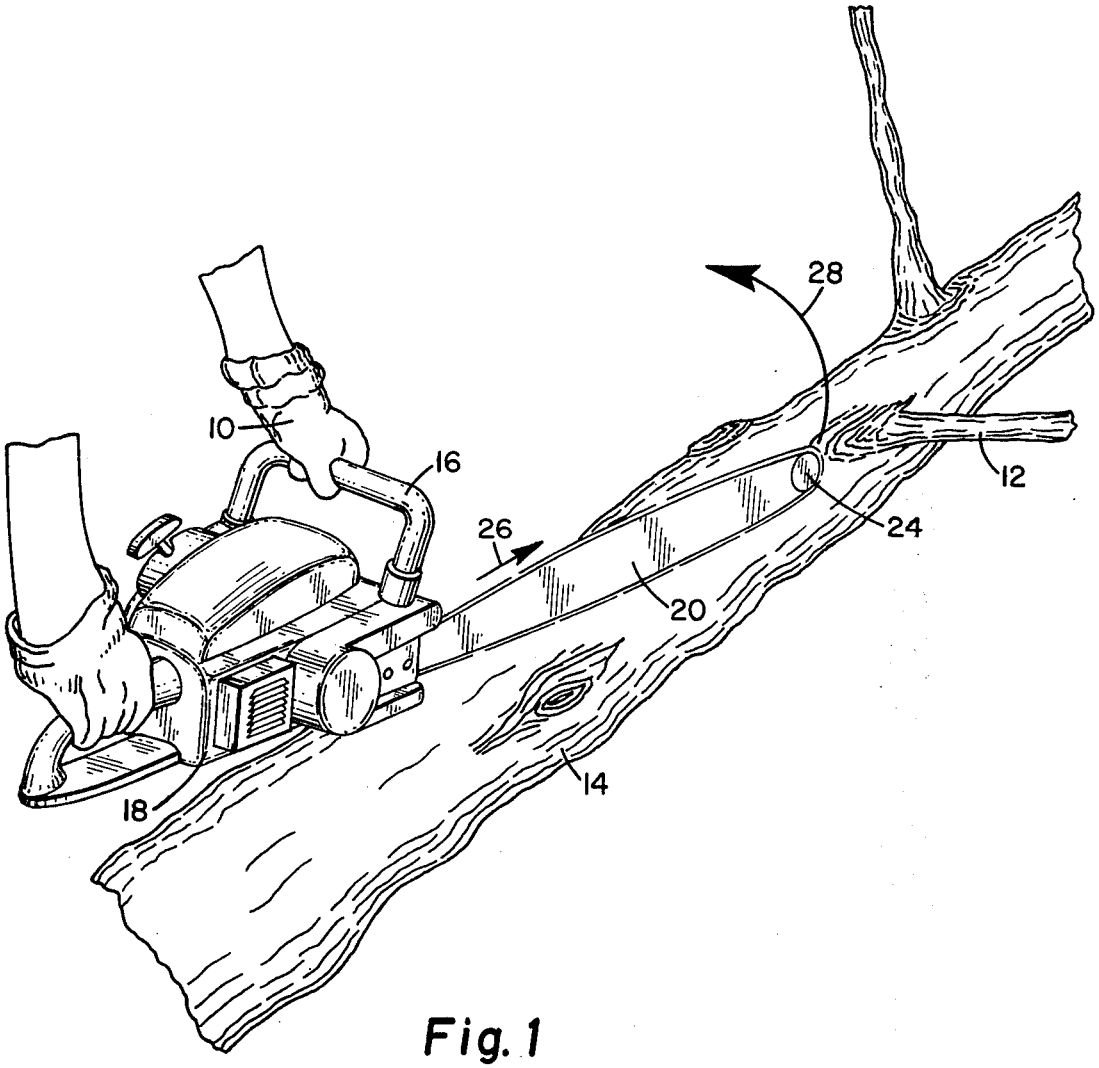
FIG. 1 illustrates a logger delimbing a tree with a chain saw having a guide bar incorporating the present invention.
Figure 2:
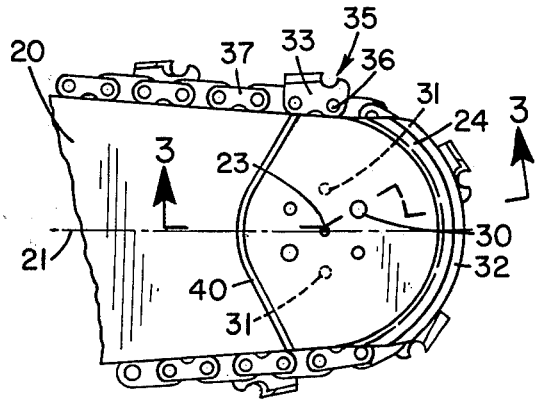
FIG. 2 is an enlarged side view of the nose of the guide bar of FIG. 1 with the corresponding portion of the saw chain passing over the nose.

Referring to FIG. 1 of the drawings, a logger 10 is shown cutting a limb 12 from a fallen tree 14 with a chain saw 16. The chain saw 16 includes a power unit 18, a guide bar 20 and a saw chain 22 entrained on the guide bar 20. The saw chain 22 is driven by the chain saw in the direction noted by arrow 24. Should the cutters of the saw chain dig into the limb 12 so as to instantly stop the chain from cutting, because the chain continues to be driven around the guide bar, the reactive effect is to throw the chain saw in a pivotal movement toward the logger as illustrated by arrow 28. This pivotal movement is commonly referred to as "kick back". It has been learned over many years of experimentation and experience that the greatest likelihood of kick back occurs while cutting at the outer end of the guide bar. Referring to FIG. 2, it will be understood that the bar is symmetrical and can be divided by an imaginary center line 21 down the length of the bar. The outer end or nose of the bar is essentially a half circle having a center of curvature 23. The imaginary line 21 divides the nose into upper and lower quadrants and it is the upper quadrant where the greatest kickback occurs. The point of greatest kickback is considered to be approximately 35° above the center line 21 measured from the center of curvature 23. In this area of the nose, when the chain digs, in, the continual chain movement forces the outer end of the bar back and up toward the operator. Although the chain saw is not typically operated so as to cut on this portion of the bar nose, through accident, carelessness or necessity, such cutting occurs frequent enough so that it is an industry-wide concern.

Figure 3:
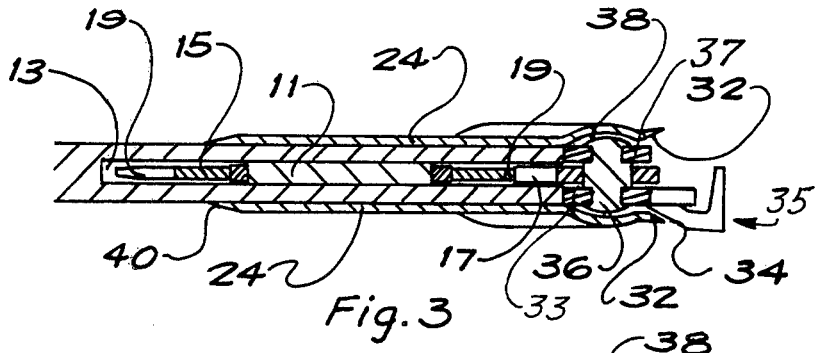
FIG. 3 is a top view of the portion of the guide bar shown in FIG. 2.
Figure 4:
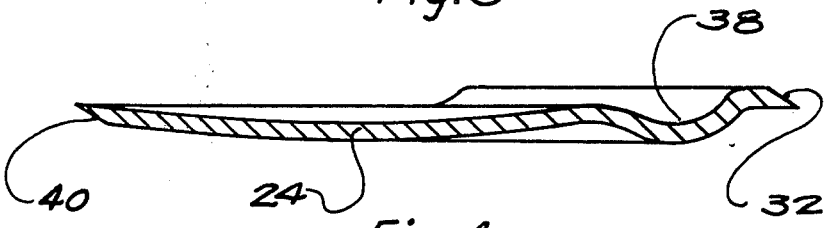
FIG. 4 illustrates the guard plate of the guide bar detached from the guide bar; and FIGS. *5a* and *5b* illustrate an alternative embodiment of the invention.
Figure 5A:
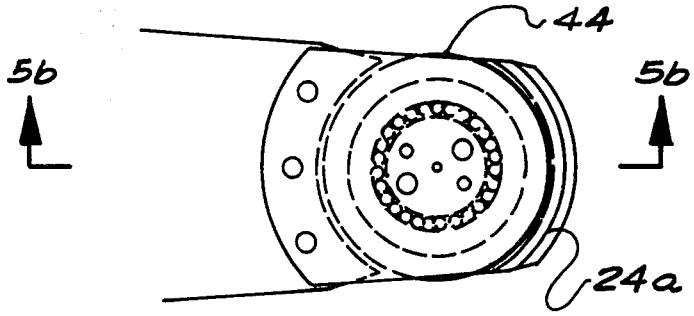
Figure 5B:
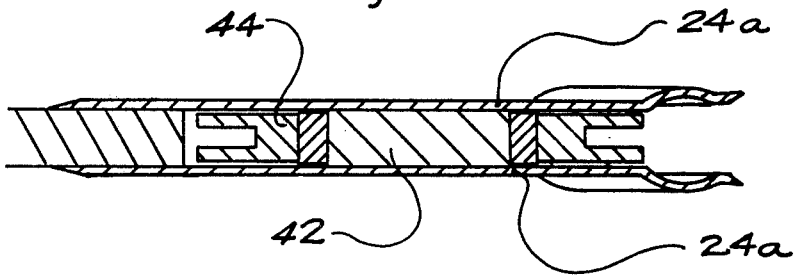

Referring now to FIGS. 2 through 4, a guard plate 24 is fixed to botn sides at the outer end of the bar 20 by rivets 30. Whereas a sprocket nose bar is illustrated, it will be understood that the guard plates 24 can be applied to the end of a solid nose bar or roller nose bar as well. The sprocket nose bar has an inner raceway 11 that is inserted in a slot 13 formed in the end of the bar and secured there by rivets. A sprocket 15 is carried by the inner raceway 11 and the sprocket teeth 19 are engaged by the drive tangs 17 of the saw chain. Whereas six rivets 30 may be used to secure the inner raceway, four of these rivets can be extended to also secure the guard plates. The two rivets 31 not securing the guard plate (shown in dotted lines in FIG. 2) hold the inner raceway in place when the other four are removed to replace the guard plate or for original assembly convenience. A roller nose bar is shown in FIGS. 5a and 5b as an alternative embodiment of the invention to be described in more detail hereafter.

The guard plate 24 as shown in FIG. 2 is shaped so as to extend along the top edge of the bar a distance just short of the outer reach of the cutter of the saw chain as it passes around the bar end. It then curves around the end of the bar conforming to the path of the saw chain until it intersects with an extended line from the bottom edge of the bar. As will be noted from FIG. 2, the saw chain which rides on the edge of the bar becomes partially covered by the guard plate as it begins to curve around the bar nose. Only a small portion of the cutter is exposed above the plate as it travels around the curved bar nose. The top edge of the guard plate thus functions as a stationary guard rail and prevents digging in of the chain to a depth greater than that permitted by the exposure of the cutter above the guard rail.

As can best be seen from FIG. 3, the saw chain cuts a kerf wider than the bar width by designing the cutters with a bend 34 outwardly of the bar. The guard plate must be inward of the cutting edge on the side wall of the cutters in order to prevent it from dragging on the kerf wall. Thus the guard plate is made from thin spring steel having a thickness of approximately 0.025 inch. The guard plate must terminate short of thin bend 34 in the cutter, and to provide maximum extension of the guard plate, the forward edge 32 is beveled or cut back to conform to the angle of the cutter bend 34. It will be seen from FIG. 3 that the forward edge 32 of the guard plate extends past the base portion 33 of the cutter link 35, i.e. that portion of the cutter link which is sectioned in FIG. 3 and conforms substantially in size and configuration to the side links 37. Whereas the rivet heads 36 on the saw chain may come into contact with the guard plate, a relief 38 can be formed in the guard plate to avoid that contact.

The rearward edge 40 of the guard plate is beveled opposite to that of the forward edge to avoid having an exposed edge that can catch in the kerf as the saw bar is moved in and out of the kerf. Also this rearward end of the guard plate is curved, again to minimize or prevent the edge from catching in the kerf. FIG. 4 illustrates the guard plate before it is rivet to the guide bar. As shown, the guard plate may be cupped slightly so that when riveted tightly to the guide bar it flattens against the bar.

Referring now to FIGS. 5*a* and 5*b*, a guard plate 24*a* is affixed to both sides of the bar and forms the support for an inner race 42 which is riveted to the guard plates. The outer race is formed in a roller 44 for supporting the saw chain as it passes around the end of the guide bar. The guard plates (one or both) are extended past the roller at the outer end of the bar to form the protective rail described for the embodiment of FIGS. 1 through 4.

Other improvements and modificiations will become apparent to those skilled in the art without departing from the scope of the invention. For example, the plate can be affixed to the bar as by spot welding, gluing, and brazing, as well as riveting. Still further, the plate can be made as an integral part of the bar. Thus, the scope of the invention is to be expanded to the definitions of the claims appended hereto.

What I claim is:

1. For a chain saw, the combination which comprises; a guide bar and a length of saw chain entrained thereon and adapted to be driven by the chain saw around the guide bar, said saw chain including center links and side links with certan side links being cutting links having a base portion from which extends a cutter portion and a depth gauge portion, said guide bar including a main bar portion having top and bottom edges and supporting means for supporting said saw chain along said edges in a manner whereby the cutter portion and depth gauge portion of the cutting links are fully exposed during cutting action, and guide means forming the nose of the guide bar for guiding the saw chain around the end of the bar from one edge to the other edge, the improvement which comprises a thin flat rigid rail fixed to the guide bar and positioned at the nose of the bar, said rail having an outer end that extends outwardly of the guide bar at the bar nose only to a point beyond the base portion and short of the outer reach of the cutter portion of the cutting links passing over the bar nose to thereby limit the exposure of the cutting links during cutting action as the saw chain passes around said bar nose.

* * * * *